United States Patent [19]

Vermillion

[11] 4,372,004

[45] Feb. 8, 1983

[54] WIDE-SWEEP CARPET CLEANER BRISTLE STRIP AND BRUSH ROLL

[75] Inventor: Don W. Vermillion, Anderson, S.C.

[73] Assignee: The Singer Company, Stamford, Conn.

[21] Appl. No.: 250,795

[22] Filed: Apr. 3, 1981

[51] Int. Cl.[3] ..... A46B 9/02; A46B 13/02

[52] U.S. Cl. ..... 15/182; 15/366; 15/195

[58] Field of Search ..... 15/179, 180, 181, 182, 15/183, 190, 191 R, 195, 196, 197, 198, 364, 365, 366, 367, 370, 386, 398, 399, 400, 401, DIG. 5

[56] References Cited

U.S. PATENT DOCUMENTS

| | | | |
|---|---|---|---|
| 3,225,374 | 12/1965 | Daley et al. | 15/366 X |
| 3,820,186 | 6/1974 | Peabody | 15/182 |
| 4,177,536 | 12/1979 | Powers | 15/182 |
| 4,307,479 | 12/1981 | Mertes et al. | 15/182 |

*Primary Examiner*—Peter Feldman

*Attorney, Agent, or Firm*—Robert E. Smith; Edward L. Bell

[57] ABSTRACT

A brush or agitator roll of a suction cleaner for carpets or other floor coverings is provided with a plurality, for example, a pair of diametrically opposed longitudinally extending spiral grooves and a bristle/agitator strip is spirally, slidably engaged in each spiral groove. Each strip has a section including a band forming part of a crowned pulley for a drive belt. On either side thereof a series of holes is provided for receiving bristle tufts. On each side, the strip is provided with a radial hole at a medial location with each succeeding bristle hole being elongated so that its inner wall is radial and the outer wall is inclined away from the center by an amount equal to the inclination of the adjacent hole plus a fixed incremental amount. Thus, although the inner edge of each hole is generally upright or radial, the outside edges are successively angled outwardly so that the holes can be molded utilizing a single core strip and the bristle tufts can be inserted and stapled radially and yet will have substantial bristles angled outwardly so as to provide a brush having a line of bristles effectively longer than the supporting strip. Grooves are also provided on the back and two sides of the strip to increase its flexibility, enabling it to be slid into the groove on the roll without the necessitating pre-heating of the strip to soften it.

4 Claims, 5 Drawing Figures

WIDE-SWEEP CARPET CLEANER BRISTLE STRIP AND BRUSH ROLL

DESCRIPTION

1. Field of the Invention

This invention relates to suction cleaning machines for carpet and other floor coverings and, more particularly, to bristle strips and brush/agitator rolls therefore.

2. Background of the Invention

In suction cleaners for carpets and other floor coverings there is generally provided a chassis which includes air passages extending from an inlet nozzle to some outlet duct or means whereby dirt laden air is sucked into the inlet nozzle and discharged through the outlet duct into some dirt collecting means. In an upright type cleaner, a dirt collection bag is generally directly attached to the outlet duct. In other such cleaners, a wand is connected with the outlet duct providing a handle for manipulation of the chassis and a hose is connected between the distal end of the wand and a separate suction and dirt separation machine. In any case, however, to be most effective for cleaning of carpets and similar floor coverings, some motor means may be provided on the chassis for rotating a brush roll rotatably mounted to the chassis within the inlet nozzle for providing agitation to the carpet or other floor covering fibers to aid in loosening dirt particles therefrom. However, in such machines a belt is generally provided between the motor and the brush roll for rotating the brush roll and the ends of the brush roll are supported in bearings. At the bearing locations and, where the drive belt passes around the brush roll, a gap in the brush bristles necessarily occurs. Hence, such a cleaner cannot uniformly clean across its entire width in a single pass.

OBJECTS OF THE INVENTION

Bearing in mind the foregoing, it is a primary object of the present invention to provide novel and improved brush rolls for carpet or other floor covering suction cleaners having improved bristle coverage.

Another primary object of the present invention, in addition to the foregoing object, is the provision of such a brush or agitator roll which is economical to manufacture and durable and effective in use.

Yet another primary object of the present invention, in addition to each of the foregoing objects, is the provision of such a brush and agitator roll which incorporates a plurality of bristle strips fabricated of a material having sufficient flexibility as to enable them to be molded in a generally linear configuration, provided with bristles while still in such generally linear configuration, and be subsequently slidably engaged into spiral grooves in the brush roll or agitator core or body.

Yet still another primary object of the present invention, in addition to each of the foregoing objects, is the provision of such brush strips having grooves provided therein to increase the flexibility thereof to aid in enabling such sliding movement thereof into such spiral grooves.

Another and still further primary object of the present invention, in addition to each of the foregoing objects, is the provision of such bristle strips and brush rolls or agitators incorporating the same, wherein bristle tufts thereof are angulated so as to extend past the ends of the bristle strips and towards the belt drive pulley area.

It is yet still a further primary object of the present invention, in addition to each of the foregoing objects, to provide such bristle strips with holes having angulated walls enabling bristle tufts stapled therein to have their bristles angulated while yet enabling the bristle tufts and staples to be inserted radially.

Another and yet still further primary object of the present invention, in addition to each of the foregoing objects, is the provision of such bristle strips having longitudinally elongated holes for the bristle tufts, the outermost wall of such elongated holes increasingly diverging so that the bristle tufts stapled therein increasingly angulate outwardly.

It is a feature of the present invention that the elongated oblong holes are generally upright at the inner end and then angled outward on the outside edges so that the tufts can be inserted radially and yet will have substantial bristles angled outwardly on the completed brush roll.

It is another feature of the present invention that the bristle strip can be molded without requiring individual pull out of cores for the bristle holes but, rather, the cores can be a single strip which may be pulled radially from the mold and the tufting also can be achieved by driving staples radially into the strip.

The invention resides in the combination, construction, arrangement and disposition of the various component parts and elements incorporated in improved bristle strips and brush/agitator rolls in suction cleaners for carpets or other floor coverings and constructed in accordance with the principles of this invention. The present invention will be better understood and objects and important features other than those specifically enumerated above will become apparent when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiment or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention, a brush or agitator roll of a suction cleaner for carpets or other floor coverings is provided with a plurality, for example, a pair of diametrically opposed longitudinally extending spiral grooves and a bristle/agitator strip is spirally, slidably engaged in each spiral groove. Each strip has a section including a band forming part of a crowned pulley for a drive belt. On either side thereof a series of holes is provided for receiving bristle tufts. On each side, the strip is provided with a radial hole at a medial location with each succeeding bristle hole being elongated so that its inner wall is radial and the outer wall is inclined away from the center by an amount equal to the inclination of the adjacent hole plus a fixed incremental amount. Thus, although the inner edge of each hole is generally upright or radial, the outside edges are successively angled outwardly so that the holes can be molded utilizing a single core strip and the bristle tufts can be inserted and stapled radially and yet will have substantial bristles angled outwardly so as to provide a brush having a line of bristles effectively longer than the supporting strip. Grooves are also provided on the back and two sides of the strip to increase its flexibility, enabling it to be slid into the groove on the roll without necessitating pre-heating of the strip to soften it.

BRIEF DESCRIPTION OF THE DRAWING

Further objects and features of the present invention, will appear from the following description and appended claims when read in conjunction with the accompanying drawing wherein:

DETAILED DESCRIPTION OF A PREFERRED EMBODIMENT

Figure 2:
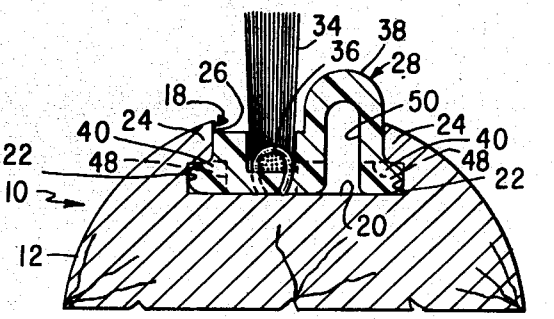
FIG. 2 is an enlarged part transverse cross section view thereof.
Figure 1:
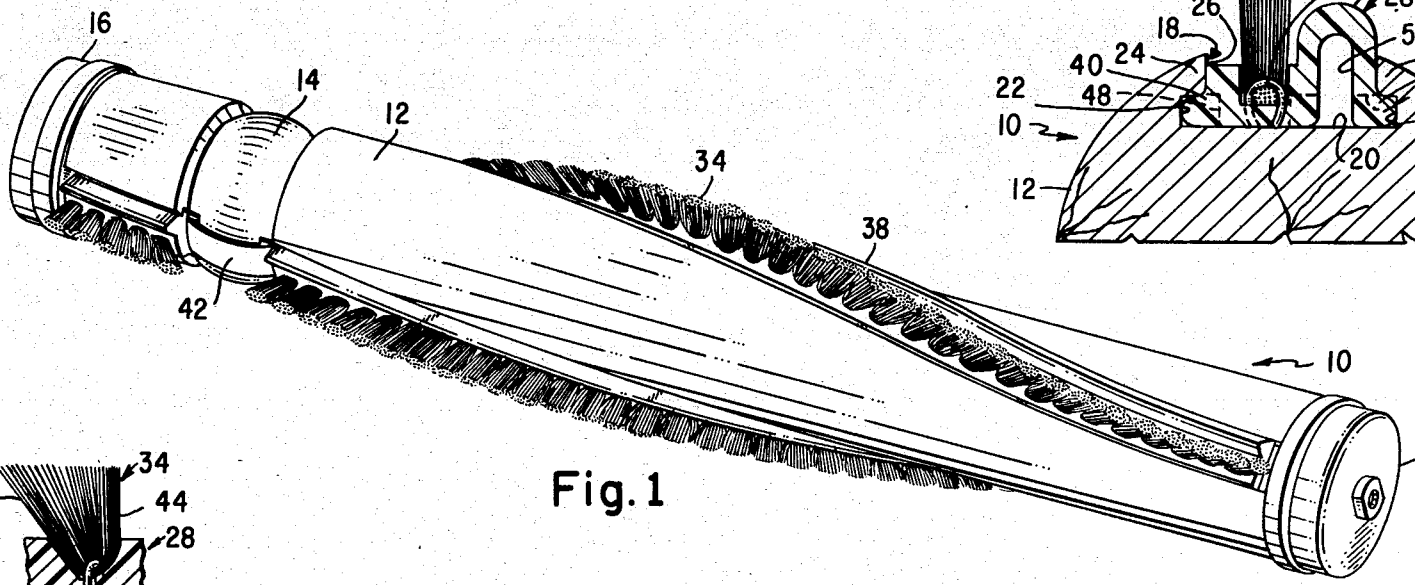
FIG. 1 is an isometric illustration of a brush/agitator roll of a suction cleaner for carpets and other floor covering in accordance with the present invention.
Figure 3:
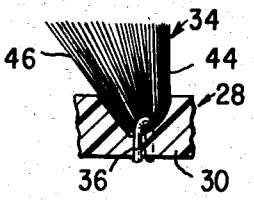
FIG. 3 is an enlarged partial longitudinal cross section with the bristle strip thereof.

With reference now to the drawing, there is shown and illustrated a beater-brush roll designated generally by the reference character 10 which comprises a cylindrical generally non-metallic preferably wooden or plastic unitary body 12 provided with an annular groove defining a crowned pulley portion 14 adjacent one end thereof and a pair of bearing caps 16, one at each end of the body 12. The bearing caps 16 may be of generally any desired construction, as is well known in the art, and may, for example, be constructed and arranged as more fully described and disclosed in U.S. Pat. No. 3,225,374 dated December 28, 1965 to Horace S. Daley et al, assigned to the assignee of the instant application, and hereby incorporated herein by reference as fully and completely as if reproduced hereat.

The body member 12 is also provided with a plurality, preferably two, diametrically opposed longitudinally extending helical undercut grooves or slots 18 which extend the complete length of the body or member 12 and are cut directly into the body or member 12. The slots 18 are identical and each has a base 20 and two outwardly extending undercut groove portions 32 defining inwardly extending shoulders 24 adjacent the periphery of the body or member 12 forming a radially open mouth 26. The helical slots 18 are identical and spiral in the same direction so that any portion of the two slots equidistantly located from the end of the body or member 12 are spaced 180° apart. Each of the grooves or slots 18 is, therefore, of generally T-shaped configuration, the open mouth 26 corresponding to the upright portion and the cross portion being defined by between the shoulders 24, the side wall 22, and the base wall 20.

Each of the slots 18 is provided with a bristle strip and beater bar combination designated generally by the reference character 28 fabricated of a rubber or plastic molding support strip 30 provided with a plurality of apertures 32 into which bristle tufts 34 are inserted and secured, as by means of staples 36, with the bristle tufts 34 extending outwardly of the apertures 32. The apertures 32 extend generally longitudinally along a line generally parallel and adjacent one edge portion of the strip 28 and the other edge portion of the strip 28 is provided with longitudinally extending concamerated beater bar portion or member 38 also extending generally longitudinally thereof. A relief slot 50 extends inside the beater bar 50. Further, outboard of the line of aperture 32 and the camerated beater bar 38, the strip 30 comprises a pair of outwardly extending shoulders 40 engaged in the slot 18 between the shoulders 24, side walls 22, and base wall 20 thereof, so as to be securely retained therein with the bristle tufts 34 and the beater bar 38 extending generally outwardly of the body or member 12 so as to contact the fibers of the carpet or other floor covering being cleaned to provide agitation and sweeping action thereof upon rotation of the brush roll 10.

Figure 4:
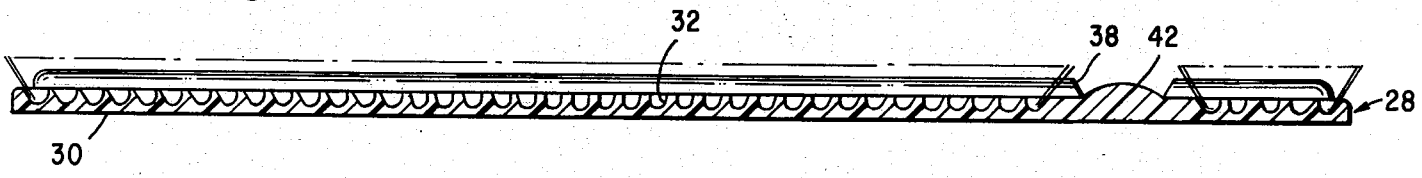
FIG. 4 is a longitudinal cross sectional view of the bristle strip without the bristle tufts stapled therein but indicating the extent and angulation of the bristle tufts; and, FIG. 5 is a top plan view thereof.

The strip 30 is shown in substantial detail in FIGS. 2–5. The slots 18 extend across the annular groove 14 defining a crowned pulley to the brush roll drive belt. Accordingly, each of the strips 28 are also provided with a crowned segmental portion 42 to form part of the surface of the crowned pulley 14. As hereinbefore pointed out, the crowned pulley 14 is spaced close to one end portion of the brush or agitator roll 10 and on either side of the crowned portion 42, the strip 28 is provided with a plurality of the apertures 32, the center hole on each side of the crowned portion 42 being radial with each succeeding bristle hole 32 being elongated so that its inner wall is radial and the outer wall is inclined away from the center holes by an amount equal to the inclination of the adjacent hole plus a fixed incremental amount. Thus, although the inner edge of each hole 32 is generally upright or radial, the outside edges are successively angled outwardly so that the bristle tufts 34 can be inserted and stapled radially and yet will have substantial bristles angled outwardly on the completed roll, as clearly shown in FIG. 3, wherein a typical bristle tuft 34 is illustrated with the innermost bristle 44 being generally radial while the outermost bristle 46 is clearly angled outwardly. This angularity is also readily apparent as depicted in FIG. 4. This arrangement of the bristle holes, that is, with the inner wall being radial and the outer wall being angled outwardly, enables the strip 28 to be molded without requiring individual pull-out of cores from the bristle holes. The core can be a single strip which is pulled radially from the mold. Likewise, the bristle tufts 34 and staples 36 can be inserted radially.

Figure 5:
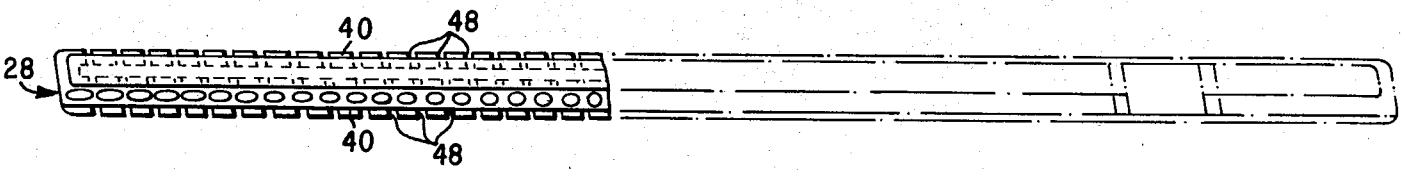

Screws 48 have also been provided, angulated relative the longitudinal extent of the bristle strips 28, on the back and sides thereof, as shown in FIGS. 2 and 5 to increase its flexibility when pulled, enabling it to be slid into the groove 18 on the wooden roll 12 without necessitating preheating of the strip to soften it.

While the invention has been described, disclosed, illustrated and shown in terms of a preferred embodiment or modification, such technical equivalence to the means described as well as their combination, and other embodiments or modifications as may be suggested to those having the benefit of the teachings herein are intended to be reserved should they be carried out according to the scope and spirit of the subjoined claims.

I claim:

1. In a brush or agitator roll of a suction cleaner for carpets or other floor coverings provided with at least a pair of diametrically opposed longitudinally extending spiral grooves and a bristle/agitator strip spirally, slidably engaged in each spiral groove, the improvement wherein each strip has a section including a band forming part of a crowned pulley for a drive belt and on either side thereof being provided with a series of holes for receiving bristle tufts wherein, on each side, the strip is provided with a radial hole at a medial location with each succeeding bristle hole being elongated so that its inner wall is radial and the outer wall is inclined away from the center by an amount equal to the inclination of the adjacent hole plus a fixed incremental amount so that although the inner edge of each hole is generally upright or radial, the outside edges are successively angled outwardly so that the holes can be molded utilizing a single core strip and the bristle tufts can be inserted and stapled radially, together with bristle tufts stapled therein having substantial bristles angled outwardly so as to provide a brush having a line of bristles effectively longer than the supporting strip.

2. Combination of claim 1 wherein grooves are also provided on the back and two sides of the strip to increase its flexibility, enabling it to be slid into the groove on the roll without necessitating pre-heating of the strip to soften it.

3. In a bristle/agitator strip including a band forming part of a crowned pulley for a drive belt and on either side thereof being provided with a series of holes for receiving bristle tufts wherein, on each side, the strip is provided with a radial hole at a medial location with each succeeding bristle hole being elongated so that its inner wall is radial and the outer wall is inclined away from the center by an amount equal to the inclination of the adjacent hole plus a fixed incremental amount so that although the inner edge of each hole is generally upright or radial, the outside edges are successively angled outwardly so that the holes can be molded utilizing a single core strip and the bristle tufts can be inserted and stapled radially, together with bristle tufts stapled therein having substantial bristles angled outwardly so as to provide a brush having a line of bristles effectively longer than the supporting strip.

4. Combination of claim 3 wherein grooves are also provided on the back and two sides of the strip to increase its flexibility, enabling it to be slid into the groove on the roll without necessitating pre-heating of the strip to soften it.

* * * * *